US008535099B1

(12) United States Patent
Lin

(10) Patent No.: US 8,535,099 B1
(45) Date of Patent: Sep. 17, 2013

(54) CARD CONNECTOR

(75) Inventor: Chih-Chiang Lin, Taipei (TW)

(73) Assignee: Proconn Technology Co., Ltd., Taipei (TW)

( * ) Notice: Subject to any disclaimer, the term of this patent is extended or adjusted under 35 U.S.C. 154(b) by 14 days.

(21) Appl. No.: 13/468,544

(22) Filed: May 10, 2012

(51) Int. Cl.
*H01R 13/648* (2006.01)

(52) U.S. Cl.
USPC ..... 439/607.4; 439/607.33

(58) Field of Classification Search
USPC .... 439/607.4, 607.31–607.35, 607.2–607.22, 439/188, 630
See application file for complete search history.

(56) References Cited

U.S. PATENT DOCUMENTS 6,511,345 B1 * 1/2003 Hwang ..... 439/541.5
6,866,544 B1 * 3/2005 Casey et al. ..... 439/607.2
7,488,212 B2 * 2/2009 Chen ..... 439/607.01
7,883,369 B1 * 2/2011 Sun et al. ..... 439/607.35

* cited by examiner

*Primary Examiner* — Phuong Dinh
(74) *Attorney, Agent, or Firm* — WPAT, P.C.; Anthony King

(57) ABSTRACT

A card connector adapted for receiving an electrical card therein includes an insulating housing, a plurality of terminals disposed to the insulating housing, a lower shielding shell and an upper shielding shell. The insulating housing has two flanks of which each defines a receiving groove penetrating through a bottom thereof, and a perforation penetrating through a top thereof and communicating with the receiving groove. The lower shielding shell covered under the insulating housing has two lateral plates. A top of each lateral plate is bent sideward to form a second buckling piece located in the receiving groove. The upper shielding shell covered on the insulating housing has a top plate of which each side edge protrudes downward to form an L-shaped first buckling piece passing through the corresponding perforation to buckle the second buckling piece of the lower shielding shell.

7 Claims, 4 Drawing Sheets

CARD CONNECTOR

BACKGROUND OF THE INVENTION

1. Field of the Invention

The present invention generally relates to a card connector, and more particularly to a card connector having a shielding shell.

2. The Related Art

A conventional card connector adapted for receiving an electrical card therein and electrically connecting with a circuit board includes an insulating housing, a plurality of terminals, an ejection mechanism assembled to the insulating housing, and a shielding shell. The insulating housing has a top wall, two side walls protruding downward from two opposite sides of the top wall, and a rear wall connecting with the two side walls and the top wall. Two outer surfaces of the two side walls respectively define a plurality of buckling blocks. The shielding shell has a top plate, and two lateral plates protruding downward from two opposite sides of the top plate. The two lateral plates are die-cut outward to form two soldering plates, and respectively define a plurality of fastening holes matched with the buckling blocks of the insulating housing. When the card connector is assembled, the terminals are disposed in the insulating housing with soldering portions thereof projecting out of the insulating housing to be soldered with the circuit board. The shielding shell encloses the insulating housing together with the terminals and the ejection mechanism with the buckling blocks being buckled in the fastening holes and the soldering plates being soldered with the circuit board.

However, according to the aforesaid description, it can be known that the shielding shell is fastened to the insulating housing only by virtue of buckling the buckling blocks of the insulating housing in the fastening holes of the shielding shell. Thereby, when the electrical card is inserted into the card connector improperly or the electrical card is shaken, the shielding shell is apt to fall off from the insulating housing. As a result, the card connector has an unstable structure and a useful life of the card connector is shortened.

SUMMARY OF THE INVENTION

An object of the present invention is to provide a card connector adapted for receiving an electrical card therein includes an insulating housing, a plurality of terminals, a lower shielding shell and an upper shielding shell. The insulating housing has a top wall, two side walls protruding downward from two opposite sides of the top wall, and a rear wall connecting with rear ends of the side walls and the top wall. An inserting space is surrounded among the top wall, the two side walls and the rear wall for receiving the electrical card therein. Two outer surfaces of the two side walls oppositely protrude outward to form two flanks of which each defines a receiving groove penetrating through a bottom thereof, and a perforation penetrating through a top thereof and communicating with the receiving groove. The terminals are disposed to the insulating housing. The lower shielding shell covered under the insulating housing has a bottom plate, and two lateral plates protruding upward from two opposite sides of the bottom plate. A top of each lateral plate is bent sideward to form a second buckling piece located in the receiving groove of the insulating housing. The upper shielding shell covered on the insulating housing has a top plate of which each side edge protrudes downward to form an L-shaped first buckling piece passing through the corresponding perforation of the insulating housing to buckle the second buckling piece of the lower shielding shell.

As described above, the two outer surfaces of the two side walls of the insulating housing oppositely protrude outward to form the two flanks of which each defines the receiving groove penetrating through the bottom thereof, and the perforation penetrating through the top thereof and communicating with the receiving groove, the lower shielding shell is covered under the insulating housing with the second buckling pieces of the lower shielding shell being located in the receiving grooves of the insulating housing, and the upper shielding shell is covered on the insulating housing with the first buckling pieces of the upper shielding shell passing through the corresponding perforations of the insulating housing to buckle the second buckling pieces of the lower shielding shell so as to integrate the upper shielding shell together with the lower shielding shell and the insulating housing tightly for effectively preventing the upper shielding shell and the lower shielding shell falling off from the insulating housing when the electrical card is inserted into the card connector improperly or the electrical card is shaken. As a result, the card connector has a stable structure and a useful life of the card connector is extended.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
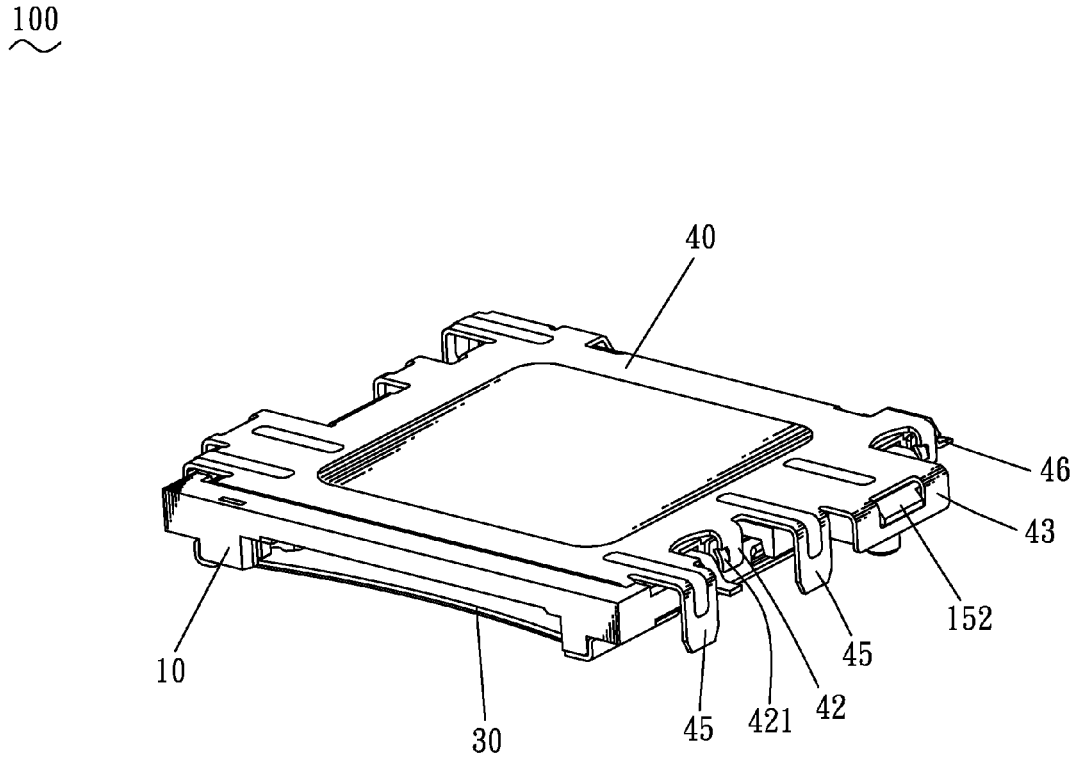
FIG. 1 is a perspective view of a card connector in accordance with the present invention.

With reference to FIG. 1, FIG. 2, FIG. 3 and FIG. 5, a card connector 100 in accordance with the present invention is shown. The card connector 100 adapted for receiving an electrical card (not shown) therein and electrically connecting with a circuit board 60 includes an insulating housing 10, a plurality of terminals (not labeled), a lower shielding shell 30 and an upper shielding shell 40.

Figure 2:
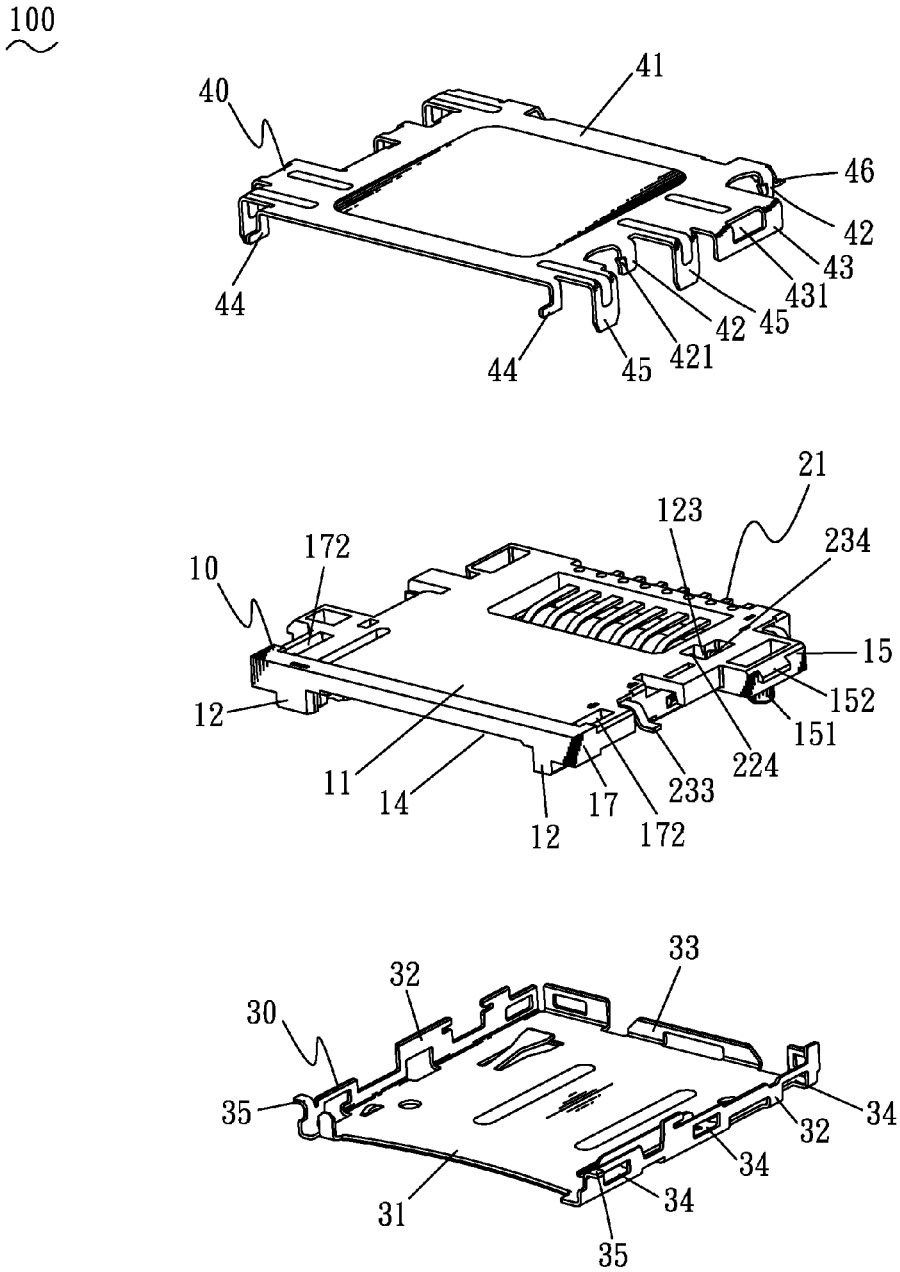
FIG. 2 is an exploded view of the card connector of FIG. 1.
Figure 3:
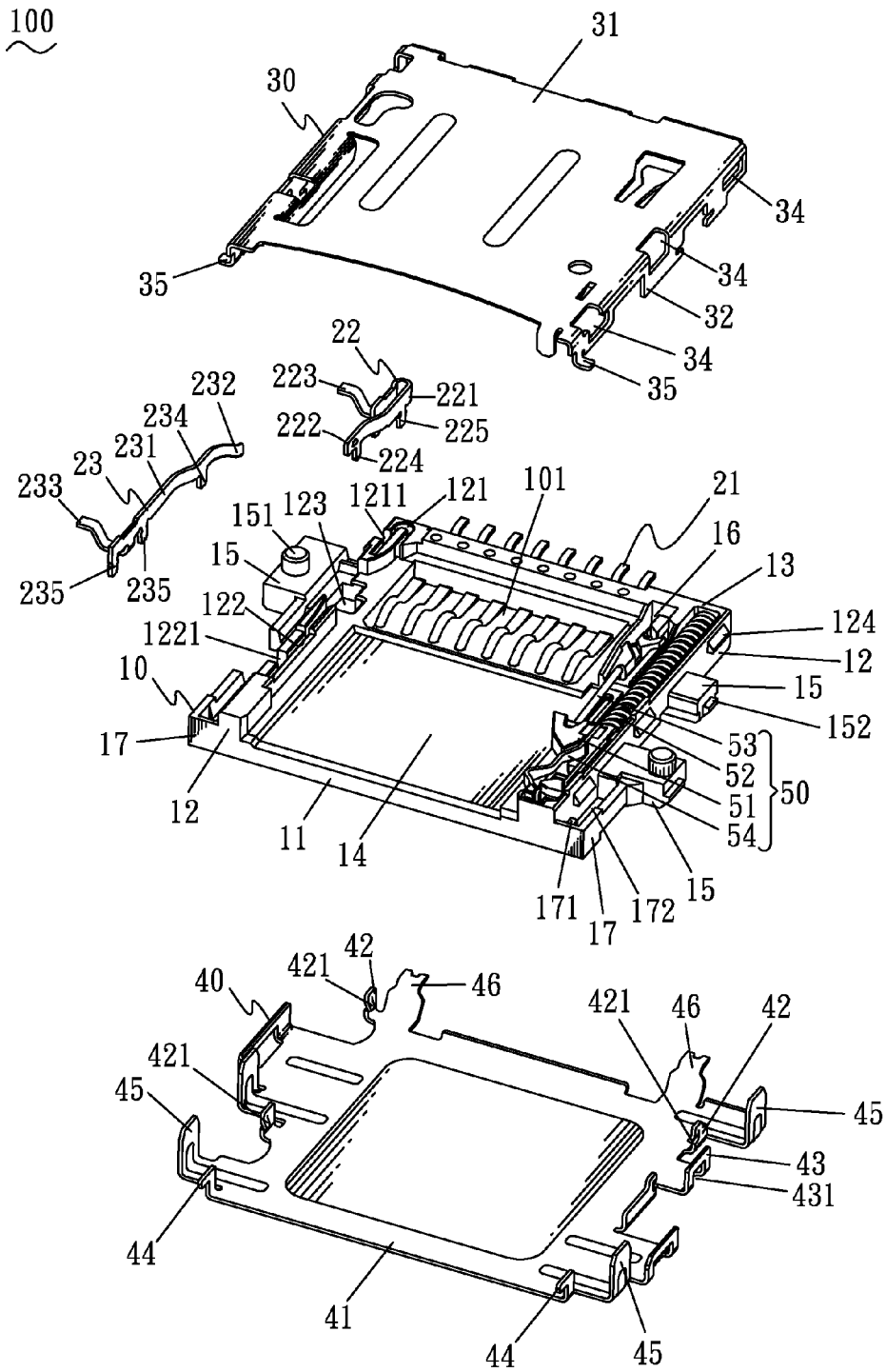
FIG. 3 is another exploded view of the card connector of FIG. 1.
Figure 4:
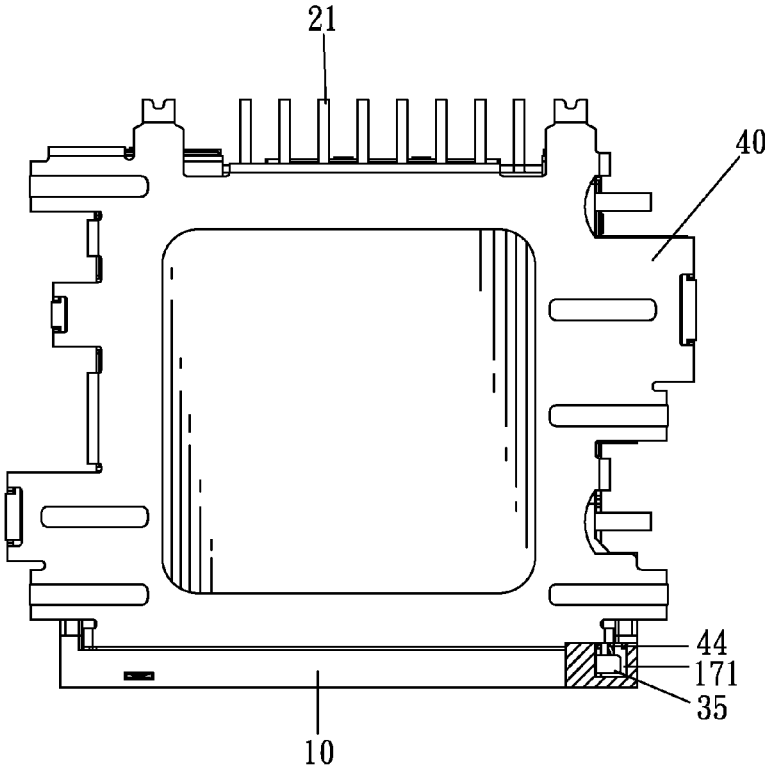
FIG. 4 is a partially sectional view of the card connector of FIG. 1.
Figure 5:
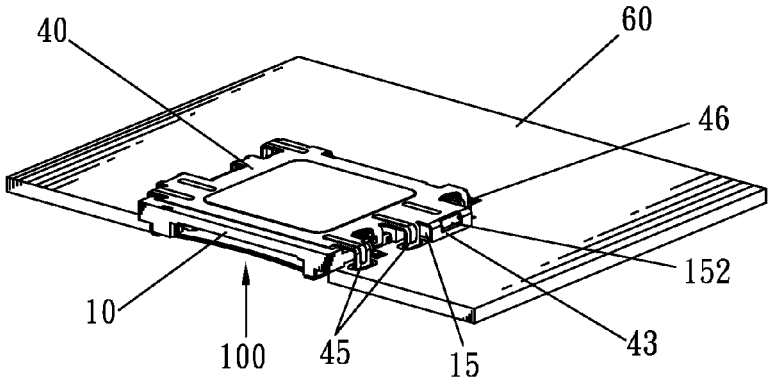
FIG. 5 is a perspective view of the card connector of FIG. 1, wherein the card connector electrically connects with a circuit board.

Referring to FIG. 2 and FIG. 3, the insulating housing 10 has a top wall 11 of a substantial rectangular shape, two side walls 12 protruding downward from two opposite sides of the top wall 11, and a rear wall 13 connecting with rear ends of the side walls 12 and the top wall 11. An inserting space 14 is surrounded among the top wall 11, the two side walls 12 and the rear wall 13 for receiving the electrical card therein. A rear of the top wall 11 defines a window 101 vertically penetrating therethrough. A bottom of one side wall 12 defines an inverted-U shaped first switch terminal groove 121 with one end thereof opened freely to communicate with the inserting space 14, and a second switch terminal groove 122 located in front of the first switch terminal groove 121. An outer sidewall of the first switch terminal groove 121 defines a first gap 1211 communicating between the first switch terminal groove 121 and an outside of the insulating housing 10. Two opposite sides of a bottom sidewall of the first switch terminal groove 121 define two first inserting holes (not shown). A rear end of the second switch terminal groove 122 is opened freely to communicate with the inserting space 14. An outer sidewall of the second switch terminal groove 122 defines a second gap 1221 communicating between the second switch terminal groove 122 and the outside of the insulating housing 10. Two opposite sides of a bottom sidewall of the second switch terminal groove 122 define two second inserting holes (not shown). A step-shaped opening 123 from a top view is defined between the first switch terminal groove 121 and the second switch terminal groove 122 of the insulating housing 10, and communicates with the inserting space 14 of the insulating housing 10. Outer surfaces of the rear wall 13 and the two side walls 12 of the insulating housing 10 define a plurality of restricting portions 124.

Each outer surface of the side wall 12 of the insulating housing 10 further protrudes outward to form at least one propping block 15 with a fastening portion 152 lumped at a free end thereof. Two bottoms of the two propping blocks 15 respectively connecting with the two outer surfaces of the two side walls 12 protrude downward to form two locating pillars 151. Two fronts of the two outer surfaces of the two side walls 12 oppositely protrude outward to form two flanks 17 of which each defines a receiving groove 171 penetrating through a bottom thereof, and a rectangular perforation 172 penetrating through a top thereof and communicating with the receiving groove 171.

Referring to FIG. 2 and FIG. 3, the terminals include a plurality of signal terminals 21, a first switch terminal 22 and a second switch terminal 23. The first switch terminal 22 has a first fastening arm 221 of a lying-U shape. A front end of one side of the first fastening arm 221 is inclined towards the other side of the first fastening arm 221, and then extends forward to form a first contact arm 222 of which a top protrudes upward to form a first blocking arm 224. Two opposite sides of the first fastening arm 221 protrude upward to form two first inserting strips 225. A top of a rear end of the other side of the first fastening arm 221 is connected with a substantial Z-shaped first soldering arm 223 from a front view. The second switch terminal 23 has an elongated second fastening arm 231. A rear end of the second fastening arm 231 is curved rearward to form a second contact arm 232 of which a top protrudes upward to form a second blocking arm 234. Two portions of the second fastening arm 231 protrude upward to form two second inserting strips 235. A front end of a top of the second fastening arm 231 is connected with a substantial Z-shaped second soldering arm 233 from the front view. The second soldering arm 233 is located between the two second inserting strips 235.

Referring to FIG. 2 and FIG. 3, the lower shielding shell 30 has a bottom plate 31, two lateral plates 32 protruding upward from two opposite sides of the bottom plate 31, and a rear plate 33 connecting with the two lateral plates 32 and the bottom plate 31. A periphery of the lower shielding shell 30 defines a plurality of restricting holes 34. Two front ends of two tops of the two lateral plates 32 are oppositely bent sideward to form two second buckling pieces 35.

Referring to FIG. 2 and FIG. 3, the upper shielding shell 40 has a top plate 41. Two fronts of two opposite side edges of the top plate 41 protrude downward and then forward to form two L-shaped first buckling pieces 44. Each side edge of the top plate 41 is elongated sideward and then bent downward to form at least one first soldering plate 45. Two portions of each side edge of the top plate 41 are bent downward to form two clamping plates 42. One side of each clamping plate 42 is punched inward to form an elastic strip 421. Each side edge of the top plate 41 is elongated sideward and then bent downward to form at least one locking plate 43 where a fastening hole 431 is opened. The first buckling piece 44, the first soldering plate 45, the clamping plate 42 and the locking plate 43 are defined in each side edge of the top plate 41 at intervals. A rear edge of the top plate 41 is bent downward and then rearward to form at least two second soldering plates 46.

Referring to FIG. 1, FIG. 2, FIG. 3 and FIG. 4, in assembly, the terminals are disposed to the insulating housing 10. Specifically, each of the signal terminals 21 is integrally molded in the insulating housing 10 with one end thereof projecting into the inserting space 14 of the insulating housing 10 through the window 101 of the insulating housing 10 and the other end thereof projecting out of the insulating housing 10 through the rear wall 13. The second fastening arm 231 of the second switch terminal 23 is disposed in the second switch terminal groove 122 of the insulating housing 10 with the second inserting strips 235 being inserted into the second inserting holes. The second soldering arm 233 of the second switch terminal 23 projects out of the second switch terminal groove 122 of the insulating housing 10 through the second gap 1221. The second contact arm 232 of the second switch terminal 23 projects into the inserting space 14 of the insulating housing 10 through the rear end of the second switch terminal groove 122 which communicates with the inserting space 14 with the second blocking arm 234 of the second switch terminal 23 abutting against an inner sidewall of a front step of the opening 123. The first fastening arm 221 of the first switch terminal 22 is disposed in the first switch terminal groove 121 of the insulating housing 10 with the first inserting strips 225 being inserted into the first inserting holes. The first soldering arm 223 of the first switch terminal 22 projects out of the first switch terminal groove 121 through the first gap 1211. The first contact arm 222 of the first switch terminal 22 is inclined towards the second contact arm 232 of the second switch terminal 23 and projects out of the first switch terminal groove 121 of the insulating housing 10 through the one end of the first switch terminal groove 121 which communicates with the inserting space 14 with the first blocking arm 224 abutting against an inner sidewall of a rear step of the opening 123.

Referring to FIG. 3, preferably, the card connector 100 further includes an ejection mechanism 50 for facilitating the electrical card being ejected out of the card connector 100. The ejection mechanism 50 is mounted to one side of a bottom of the top wall 11 adjacent to the other side wall 12. The ejection mechanism 50 includes a sliding block 51, an elastic element 52, a guiding element 53 and an auxiliary piece 54. The sliding block 51 is disposed to a front of the one side of the bottom of the top wall 11 adjacent to the other side wall 12. A rear of the one side of the bottom of the top wall 11 defines a heart-shaped sliding groove 16. A blocking block (not labeled) is disposed in the sliding groove 16. The guiding element 53 has a fastening portion (not shown) fastened to the sliding block 51 and a sliding portion (not labeled) slidably disposed in the sliding groove 16. The elastic element 52 is disposed between the sliding block 51 and the rear wall 13. The auxiliary piece 54 is disposed in the sliding block 51 with a portion thereof projecting into the inserting space 14 of the insulating housing 10.

Referring to FIGS. 1-4, the lower shielding shell 30 is covered under the insulating housing 10. The lower shielding shell 30 is fastened to the insulating housing 10 firmly by virtue of restricting the restricting portions 124 in the restricting holes 34. The second buckling pieces 35 of the lower shielding shell 30 are located in the receiving grooves 171 of the flanks 17 of the insulating housing 10. The upper shielding shell 40 is covered on the insulating housing 10. The upper shielding shell 40 is fastened to the insulating housing 10 firmly by virtue of making the clamping plates 42 attached to the two lateral plates 32 of the lower shielding shell 30 with the elastic strips 421 resisting against outer surfaces of the two lateral plates 32 of the lower shielding shell 30, and making the locking plate 43 against the propping block 15 with the fastening portion 152 being fastened in fastening hole 431. The first buckling pieces 44 of the upper shielding shell 40 pass through the corresponding perforations 172 of the flanks 17 of the insulating housing 10 to buckle the second buckling pieces 35 of the lower shielding shell 30 so as to integrate the upper shielding shell 40 together with the lower shielding shell 30 and the insulating housing 10 tightly for effectively preventing the upper shielding shell 40 and the lower shielding shell 30 falling off from the insulating housing 10 when the electrical card is inserted into the card connector 100 improperly or the electrical card is shaken. The first soldering plate 45 and the second soldering plate 46 of the upper shielding shell 40 are propped up by the two side walls 12 of the insulating housing 10.

Referring to FIGS. 1-5, in use, the card connector 100 is mounted to the circuit board 60 to electrically connect with the circuit board 60. A middle of one end of the circuit board 60 is cut off to define an assembling groove (not shown). The circuit board 60 defines a plurality of inserting slots (not shown) located at two opposite sides of the assembling groove, and a plurality of soldering pads (not shown) located in rear of the assembling groove. The card connector 100 partially passes through the assembling groove of the circuit board 60. The locating pillars 151 of the propping blocks 15 are mounted on the circuit board 60. The ends of the signal terminals 21 projecting out of the insulating housing 10 through the rear wall 13 are soldered on the circuit board 60, and the first soldering arm 223 of the first switch terminal 22 and the second soldering arm 233 of the second switch terminal 23 are soldered on the circuit board 60 to electrically connect the card connector 100 with the circuit board 60. The first soldering plates 45 of the upper shielding shell 40 are inserted into the inserting slots of the circuit board 60 and soldered with the circuit board 60, and the second soldering plates 46 of the upper shielding shell 40 are soldered with the soldering pads of the circuit board 60 so as to make the card connector 100 mounted to the circuit board 60 firmly.

Referring to FIGS. 1-5 again, when the electrical card is inserted into the inserting space 14 of the insulating housing 10 of the card connector 100, the electrical card pushes the sliding block 51 of the ejection mechanism 50 rearward to bring along the sliding portion of the guiding element 53 to slide in the sliding groove 16 until the sliding portion of the guiding element 53 is blocked by the blocking block of the ejection mechanism 50. The elastic element 52 shows a compressing status. The portion of the auxiliary piece 54 projecting into the inserting space 14 resists against the electrical card to restrain the electrical card in the inserting space 14 of the insulating housing 10 of the card connector 100. At this moment, the electrical card is fully inserted into the inserting space 14 of the card connector 100, the second contact arm 232 of the second switch terminal 23 presses against the first contact arm 222 of the first switch terminal 22 to electrically connect the second contact arm 232 of the second switch terminal 23 with the first contact arm 222 of the first switch terminal 22. The one ends of the signal terminals 21 electrically contact with the electrical card to realize an electrical connection between the electrical card and the card connector 100. When the electrical card is ejected out of the inserting space 14 of the insulating housing 10 of the card connector 100, push the electrical card rearward again to make the sliding portion of the guiding element 53 slide out of the sliding groove 16. The elastic element 52 is rebounded to an original status to make the sliding block 51 push the electrical card out of the inserting space 14 of the card connector 100. In the meanwhile, the second contact arm 232 of the second switch terminal 23 is apart from the first contact arm 222 of the first switch terminal 22.

As described above, the two fronts of the two outer surfaces of the two side walls 12 of the insulating housing 10 oppositely protrude outward to form the two flanks 17 of which defines the receiving groove 171 penetrating through the bottom thereof, and the perforation 172 penetrating through the top thereof and communicating with the receiving groove 171, the lower shielding shell 30 is covered under the insulating housing 10 with the second buckling pieces 35 of the lower shielding shell 30 being located in the receiving grooves 171 of the insulating housing 10, and the upper shielding shell 40 is covered on the insulating housing 10 with the first buckling pieces 44 of the upper shielding shell 40 passing through the corresponding perforations 172 of the insulating housing 10 to buckle the second buckling pieces 35 of the lower shielding shell 30 so as to integrate the upper shielding shell 40 together with the lower shielding shell 30 and the insulating housing 10 tightly for effectively preventing the upper shielding shell 40 and the lower shielding shell 30 falling off from the insulating housing 10 when the electrical card is inserted into the card connector 100 improperly or the electrical card is shaken. As a result, the card connector 100 has a stable structure and a useful life of the card connector 100 is extended.

What is claimed is:

1. A card connector adapted for receiving an electrical card therein, comprising:

an insulating housing having a top wall, two side walls protruding downward from two opposite sides of the top wall, and a rear wall connecting with rear ends of the side walls and the top wall, an inserting space being surrounded among the top wall, the two side walls and the rear wall for receiving the electrical card therein, two outer surfaces of the two side walls oppositely protruding outward to form two flanks of which each defines a receiving groove penetrating through a bottom thereof, and a perforation penetrating through a top thereof and communicating with the receiving groove;

a plurality of terminals disposed to the insulating housing;

a lower shielding shell covered under the insulating housing, the lower shielding shell having a bottom plate and two lateral plates bending upward from two opposite sides of the bottom plate, a top of each lateral plate being bent sideward to form a second buckling piece located in the receiving groove of the insulating housing; and an upper shielding shell covered on the insulating housing, the upper shielding shell having a top plate of which each side edge protrudes downward to form an L-shaped first buckling piece passing through the corresponding perforation of the insulating housing to buckle the second buckling piece of the lower shielding shell.

2. The card connector as claimed in claim 1, wherein each outer surface of the side wall of the insulating housing further protrudes outward to form at least one propping block with a fastening portion lumped at a free end thereof, each side edge of the top plate of the upper shielding shell is elongated sideward and then bent downward to form at least one locking plate where a fastening hole is opened, the locking plate is against the corresponding propping block with the fastening portion being fastened in the fastening hole.

3. The card connector as claimed in claim 1, wherein an outer surface of the rear wall and the outer surfaces of the two side walls of the insulating housing define a plurality of restricting portions, a periphery of the lower shielding shell defines a plurality of restricting holes for restricting the restricting portions therein.

4. The card connector as claimed in claim 3, wherein two portions of each side edge of the top plate of the upper shielding shell are bent downward to form two clamping plates of which each is punched inward to form an elastic strip, the clamping plates are attached to the two lateral plates of the lower shielding shell with the elastic strips resisting against two outer surfaces of the two lateral plates of the lower shielding shell.

5. The card connector as claimed in claim 1, wherein each side edge of the top plate of the upper shielding shell is elongated sideward and then bent downward to form at least one first soldering plate soldered with a circuit board, a rear edge of the top plate is bent downward and then rearward to form at least two second soldering plates soldered with the circuit board.

6. The card connector as claimed in claim 1, wherein a bottom of one side wall of the insulating housing defines a first switch terminal groove with one end thereof opened freely to communicate with the inserting space, and a second switch terminal groove located in front of the first switch terminal groove, a rear end of the second switch terminal groove is opened freely to communicate with the inserting space, the terminals include a second switch terminal and a first switch terminal, the second switch terminal has a second fastening arm disposed in the second switch terminal groove, a rear end of the second fastening arm is curved rearward to form a second contact arm projecting into the inserting space of the insulating housing through the rear end of the second switch terminal groove, the first switch terminal has a first fastening arm disposed in the first switch terminal groove, a front end of the first fastening arm is inclined towards the second contact arm and then extends forward to form a first contact arm projecting out of the first switch terminal groove of the insulating housing through the one end of the first switch terminal groove, the second contact arm of the second switch terminal presses against or is apart from the first contact arm of the first switch terminal when the electrical card is inserted into or ejected out of the inserting space of the card connector.

7. The card connector as claimed in claim 6, wherein a lying-step shaped opening is defined between the first switch terminal groove and the second switch terminal groove of the insulating housing, and communicates with the inserting space of the insulating housing, a top of the first contact arm of the first switch terminal protrudes upward to form a first blocking arm abutting against an inner sidewall of a rear step of the opening, a top of the second contact arm of the second switch terminal protrudes upward to form a second blocking arm abutting against an inner sidewall of a front step of the opening.

* * * * *